US007139711B2

(12) United States Patent
Grover

(10) Patent No.: US 7,139,711 B2
(45) Date of Patent: Nov. 21, 2006

(54) NOISE FILTERING UTILIZING NON-GAUSSIAN SIGNAL STATISTICS

(75) Inventor: Morgan Grover, Pacific Palisades, CA (US)

(73) Assignee: Defense Group Inc., Falls Church, VA (US)

( * ) Notice: Subject to any disclaimer, the term of this patent is extended or adjusted under 35 U.S.C. 154(b) by 532 days.

(21) Appl. No.: 09/990,317

(22) Filed: Nov. 23, 2001

(65) Prior Publication Data

US 2003/0004715 A1 Jan. 2, 2003

Related U.S. Application Data

(60) Provisional application No. 60/252,427, filed on Nov. 22, 2000.

(51) Int. Cl.
*G10L 13/08* (2006.01)

(52) U.S. Cl. ..... 704/260; 704/226; 704/225

(58) Field of Classification Search ..... 704/233, 704/234, 210, 226, 215, 227, 228, 205, 219–222, 704/260, 270

See application file for complete search history.

(56) References Cited

U.S. PATENT DOCUMENTS

| | | | | |
|---|---|---|---|---|
| 4,811,404 | A | 3/1989 | Vilmur et al. | |
| 5,491,771 | A | 2/1996 | Gupta et al. | |
| 5,544,250 | A | 8/1996 | Urbanski | |
| 5,742,927 | A | 4/1998 | Crozier et al. | |
| 5,768,473 | A | 6/1998 | Eatwell et al. | |
| 5,819,217 | A | 10/1998 | Raman | |
| 5,826,222 | A | 10/1998 | Griffin | |
| 5,907,822 | A | 5/1999 | Prieto, Jr. | |
| 5,966,689 | A | 10/1999 | McCree | |
| 5,974,373 | A | 10/1999 | Chan et al. | |
| 6,032,114 | A | 2/2000 | Chan | |
| 6,038,532 | A | 3/2000 | Kane et al. | |
| 6,098,038 | A | 8/2000 | Hermansky et al. | |
| 6,108,610 | A | 8/2000 | Winn | |
| 6,349,278 | B1 * | 2/2002 | Krasny et al. | 704/233 |
| 6,408,269 | B1 * | 6/2002 | Wu et al. | 704/228 |
| 6,415,253 | B1 * | 7/2002 | Johnson | 704/210 |

OTHER PUBLICATIONS

Goodsill, S.J., "Robust modelling of noisy ARMA signals" Acoustics, Speech, and Signal Processing, 1997. ICASSP-97., 1997 IEEE International Conference on , vol. 5, Apr. 21-24, 1997, pp. 3797-3800 vol. 5.*

(Continued)

*Primary Examiner*—Richemond Dorvil
*Assistant Examiner*—Huyen X. Vo
(74) *Attorney, Agent, or Firm*—Hoffman, Wasson & Gitler, P.C.

(57) ABSTRACT

The present invention is directed to a method and system for capturing an information signal from within a noisy background utilizing a non-Gaussian model for the a priori statistics of the information signal conditioned on other a priori quantities. A specific implementation utilizing a Gaussian Mixture Model (GMM) is described. The GMM implementation includes Wiener filtering as a special case, and includes methods for adaptively tracking multiple properties of the input noise and the information signal, including noise PSD, information signal PSD, information signal spectral amplitude, and probability of information signal presence versus time and frequency.

15 Claims, 4 Drawing Sheets

OTHER PUBLICATIONS

B. Lee, et al., "An EM-based Approach for Parameter Enhancement with an Application to Speech Signals," Signal Processing, vol. 46, No. 1, Sep. 1995, pp. 1-14.*

"Speech Enhancement Using a Minimum Mean-Square Error Short-Time Spectral Amplitude Estimator", Yariv Ephraim and David Malah, Transactions on Acoustics, Speech, and Signal Processing, vol. ASSP-32, No. 6, Dec. 1984, pp. 1109-1121.

"Tracking Speech-Presence Uncertainty to Improve Speech Enhancement in Non-Stationary Noise Environments", David Malah, Richard V. Cox, and Anthony J. Accardi, ICASSP 1999.

"Estimation of Noise Spectrum and its Application to SNR-Estimation and Speech Enhancement", H. Gunter Hirsch; Technical Report TR-93-012, International Computer Science Institute, Berkeley, California, pp. 1-32.

* cited by examiner

NOISE FILTERING UTILIZING NON-GAUSSIAN SIGNAL STATISTICS

CROSS REFERENCE TO RELATED APPLICATIONS

The present application is based upon Provisional Patent Application Serial No. 60/252,427, filed on Nov. 22, 2000.

BACKGROUND OF THE INVENTION

1. Field of the Invention

The present invention is directed to the field of signal processing for noise removal or reduction in which speech or other information signals are received contaminated with noise and it is desired to reduce or remove the noise while preserving the speech or other information signals.

2. Description of Prior Art

The prior art is replete with methods for processing speech or other signals that are contaminated with noise. Many prior methods use empirical techniques, including but not limited to spectral subtraction as an example, that cannot be shown from basic principles to have the potential to approach near-optimal performance. In other cases, including but not limited to Wiener filtering as an example, a theoretical basis is known, but the theory and resulting methods are based on the assumption that the signal of interest has a Gaussian distribution conditioned on a priori quantities used to parameterize the processing. While the model of Gaussian statistics may often be acceptable for noise, it is not generally a good model for speech or other signals to be recovered from the noise. Furthermore, the optimal filtering is very different from Wiener filtering or spectral subtraction when the non-Gaussian nature of the speech or other signal is taken into account.

Selected prior art patents directed to this field include U.S. Pat. No. 5,768,473 issued to Eatwell et al; U.S. Pat. No. 6,098,038 issued to Hermansky et al and U.S. Pat. No. 6,108,610 issued to Winn. Numerous additional prior art patents and publications are cited in the above, and are included herein by reference.

The patent to Eatwell et al describes a method for estimating frequency components of an information signal from an input signal containing both the information signal and noise. The method is a modified version of that described in U.S. Pat. No. 4,158,168 issued to Graupe and Causey. Claimed improvements are a noise power estimator, for which a plurality of options are described, and a computationally efficient gain calculation. An added noise power estimator is described in the related patent to Winn. In the patent to Eatwell et al the gain calculation is described as capable of implementing the gain function published by Ephraim and Malah in "Speech enhancement using a minimum mean-square error short-time spectral amplitude estimator", IEEE Transactions on Acoustics, Speech and Signal Processing, Vol. ASSP-32, No. 6, December 1984, and which is based on the assumption of Gaussian speech statistics.

The patent to Hermansky et al describes a method where noisy speech signals are decomposed into frequency bands, signal-to-noise ratio (SNR) in each band is estimated, each frequency band signal is filtered with a prepared filter parameterized by SNR, and the filtered band signals are recombined. The SNR-parameterized filters are proposed to be prepared from prior empirical tests. One suggested means for performing the SNR estimating is the method disclosed by Hirsch in "Estimation Of Noise Spectrum And Its Application To SNR Estimation And Speech Enhancement", Technical Report TR-93-012, International Computer Science Institute, Berkeley, Calif., 1993.

These and other patents, methods, and publications in the prior art address systems and methods based on empirical designs, or on theoretical bases that rely on the assumption that information signal statistics conditioned on a priori quantities may be represented by a Gaussian distribution, or a combination of the above, or else are silent as to whether Gaussian signal statistics are assumed.

SUMMARY OF THE INVENTION

The deficiencies of the prior art are addressed by the method and system of the present invention for extracting or enhancing information signals from noisy inputs with recognition of the generally non-Gaussian nature of information signal statistics conditioned on a priori quantities. As a specific implementation means for representing the non-Gaussian nature of information signal statistics the present invention uses a Gaussian Mixture Model (GMM) to represent the distribution function of the signal conditioned on a priori quantities, but it is noted that other non-Gaussian models can equally be employed. The present invention also provides a foundation and specific methods for adaptively estimating multiple time-varying properties of the noisy input signal, including but not limited to: the power spectral density (PSD) and waveform of the noise, the PSD of the information signal, the information signal's spectral amplitude and waveform, and the probability of an information signal being present in specified time windows and frequency intervals.

Therefore, it is an object of the present invention to provide a noise reduction filter including the non-Gaussian nature of a priori signal statistics, and illustrated by specific implementations utilizing a Gaussian Mixture Model to model the non-Gaussian statistics of the desired information signal.

It is yet another object of the present invention to provide a noise removal or reduction filtering method capable of automatically and adaptively tracking the noise PSD, the speech or information signal PSD, the speech or information signal waveform, and the probability of signal presence versus frequency and time.

Other objects of the present invention will be apparent based upon a further explanation of the method and system of the present invention.

BRIEF DESCRIPTION OF THE DRAWINGS

The foregoing and other objects, aspects and advantages of the present invention will be better understood from the following detailed description of a preferred embodiment of the invention with reference to the drawings, in which.

DETAILED DESCRIPTION OF THE INVENTION

The present invention is directed to a system and method of providing a signal filter employing a Gaussian Mixture Model (GMM) or other non-Gaussian model to extract a speech or other information signal from a noisy environment. For brevity of presentation, the following will mainly describe the information signal as being a speech signal, but it will be apparent that the method of the invention is not limited to just that area of application.

The present invention models noise as a time-correlated Gaussian random process, parameterized by it's a priori Power Spectral Density (PSD) versus frequency, $P_N(f)$, where f is the frequency. The noise spectral amplitude n(f) has the distribution function shown in Equation 1. $P_N(f)$ is dynamically updated throughout the processing. In the following, frequency dependence will be made explicit only as needed. Also, consistent with methods technical discussions in this field, the term "power" will generally refer to the PSD.

$$f_n(n)=2n/P_N Exp(-n^2/P_N) \qquad \text{Equation 1}$$

The distribution function of speech is modeled as a GMM of time-correlated samples, leading to a distribution function for the speech spectral amplitude s(f) as shown in Equation 2, where δ(s) is a one-sided Dirac delta function. The first term on the right hand side (RHS) of Equation 2 represents a signal of zero power, thus capturing the possibility that no signal of interest is present. The components of the summation in the second term on the RHS of Equation 2 are the components of the GMM model for the speech distribution function.

$$f_s(s) = (1-q_S)\delta(s) + q_S\left\{2s\sum_i \frac{a_i}{\rho_i}\mathrm{Exp}(-s^2/\rho_i)\right\} \qquad \text{Equation 2}$$

This speech model has two sets of frequency band dependent parameters which are dynamically updated during the processing, $P_s(f)$ and $q_s(f)$. The first is the a priori PSD of the speech, assuming that a speech signal is present at the frequency and time of interest. The second parameter is the a priori probability of a speech signal being present at that frequency and time. The speech distribution function also has a number of added parameters, $\{a_I\}=\{a_1,a_2, \ldots a_N\}$ and $\{\rho_i°\}=(\rho_1°, \rho_2°, \ldots \rho_N°\}$. The $\{a_i\}$ are the weights of the N Gaussian components of the GMM, and the $\{\rho_i°\}$ are the powers of each component when the speech PSD is normalized to $P_s(f)=1$. In practice, $P_s(f)$ and $\{\rho_i°\}$ are combined into a parameter set denoted as $\{\rho_i(f)\}$, where $\rho_i(f)=\rho_i° P_s(f)$.

Figure 1:
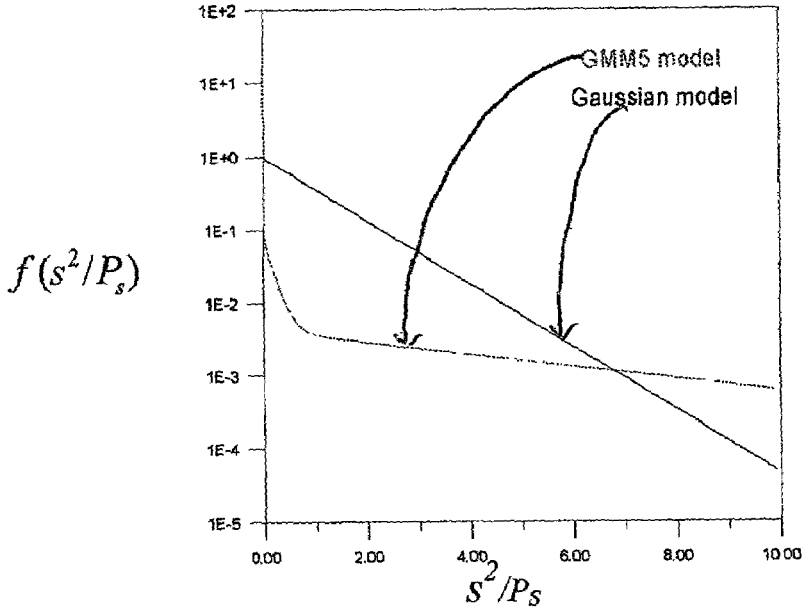
FIG. 1 is a graph showing a typical GMM speech distribution as compared with a Gaussian speech distribution.

While both $P_s(f)$ and $q_s(f)$ are dynamically updated during the processing, the $\{a_i\}$ and are $\{\rho_i°\}$ determined from prior "training" to optimize processing results as averaged over a representative body of training data. This may typically be done by minimizing the mean-squared-error (MSE) between noise free signals and the results from processing noisy input signals based on those signals by mixing with varying types and levels of interfering noise. The present invention may typically use five GMM components (denoted GMM5). However, more or less than five components can be employed. In addition, the $\{a_i\}$ may be further parameterized by the values of other key quantities, including but not limited to signal-to-noise ratio (SNR), which are adaptively and dynamically updated throughout the processing. This may typically be done by determining different GMM model parameter values (the $\{a_i\}$ and $\{\rho_i°\}$) versus SNR based on training for different input SNRs, and interpolating between these model parameter values based on the adaptively estimated input SNR during the processing. One prior training of a GMM5 leads to a model for the speech distribution as shown in FIG. 1 for $q_s=0.5$. Also shown is the corresponding distribution function for a Gaussian speech model with $q_s=1$. For presentation purposes, the vertical axis is actually the distribution function for speech spectral power, which is simply $f(s^2/P_s)$, and the horizontal axis is $(s^2/P_s)$.

Noise PSD updating is mainly based on the following. Given a priori distribution functions for the noise and speech spectral amplitudes, and a new measurement of the noisy signal spectral amplitude, r(f), a determination is made as to a best a posteriori estimate of the noise spectral power for use in updating the noise PSD. This can be expressed in Equation 3, where $<n^2\backslash r>$ is the expected value of the noise spectral power given the input, f(r\n) is the input's distribution function conditioned on a noise spectral amplitude n, and $f_r(r)$ is the a priori distribution function for the noisy input measurement.

$$<n^2\backslash r>=\int dn\ n^2 f(r\backslash n) f_n(n)/f_r(r) \qquad \text{Equation 3}$$

Since speech and noise are additive, f(r\n) and $f_r(r)$ can be expressed as $$f(r\mid n) = (1-q_S)\delta(r-n) + 2q_S r\sum_i \frac{a_i}{\rho_i} I_0\left(\frac{2rn}{\rho_i}\right)\mathrm{Exp}\left(-\frac{r^2+n^2}{\rho_i}\right) \qquad \text{Equation 4}$$

where $I_o(x)$ is the zeroth-order imaginary Bessel function, and $$f_r(r) = \frac{2r}{P_N}\mathrm{Exp}\left(-\frac{r^2}{P_N}\right)\left[(1-q_S) + q_S\sum_i \frac{a_i}{1+S_i}\mathrm{Exp}\left(\frac{r^2 S_i}{P_N(1+S_i)}\right)\right] \qquad \text{Equation 5}$$

where $S_{i=\rho i}/P_N$

This leads to the result $$<n^2 \mid r> = \frac{(1-q_S)r^2 + q_S P_N \sum_i a_i \frac{S_i}{(1+S_i)^2} \left(1 + \frac{r^2}{P_N}\{S_i(1+S_i)\}^{-1}\right) \mathrm{Exp}\left[(r^2/P_N)\left(\frac{S_i}{1+S_i}\right)\right]}{(1-q_S) + q_S \sum_i a_i (1+S_i)^{-1} \mathrm{Exp}\left[(r^2/P_N)\left(\frac{S_i}{1+S_i}\right)\right]} \quad \text{Equation 6}$$

Figure 2A:
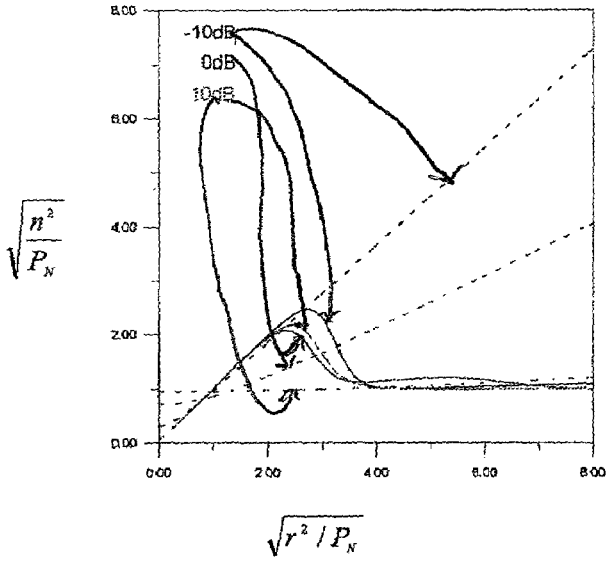
FIG. 2*a* is a graph showing typical noise power (PSD) estimators with a GMM speech model compared to a basic Gaussian model.
Figure 2B:
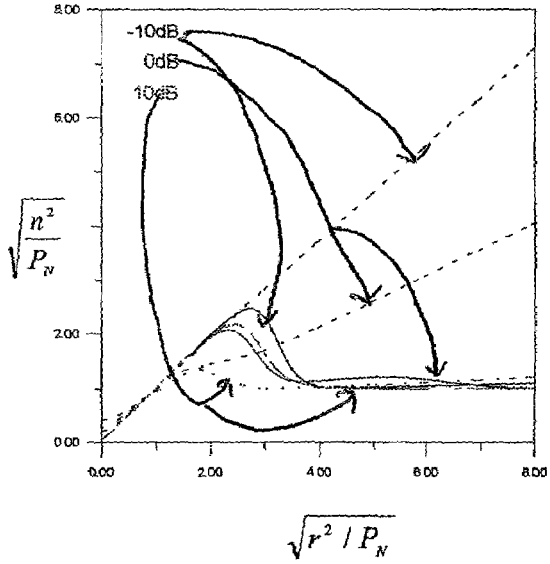
FIG. 2*b* shows a graph comparing typical noise power (PSD) estimators with a GMM speech model to an extended Gaussian model that includes a non-unity probability of signal presence.

The form of this noise estimator for a typical GMM5 speech distribution is graphically depicted in FIGS. 2*a* and 2*b* where the noise estimator from the GMM5 model is shown in solid lines. In these figures, the vertical axis is $(<n^2\backslash r>/P_N)^{1/2}$, and the horizontal axis is $(r^2/P_N)^{1/2}$. The GMM5 results are shown for different SNRs at $q_s=1/2$. Corresponding results are shown in dashed lines for a simple Gaussian speech distribution at $q_s=1$, and an extended Gaussian distribution with $q_s=1/2$.

FIGS. 2*a* and 2*b* show that for high a priori SNR and also high instantaneous $(r^2/P_N)^{1/2}$, all models infer that the current noise power is close to the a priori value. Since the speech is assumed to be dominant at high a priori SNR, given a high input in terms of $(r^2/P_N)^{1/2}$, the noise power estimate is allowed to "coast." Conversely, for low SNR and high instantaneous $(r^2/P_N)^{1/2}$, the Gaussian models overestimate the noise since they do not anticipate the possibility of occasional strong speech power as the explanation of the high $(r^2/P_N)^{1/2}$. Gaussian models also overestimate the noise at low $(r^2/P_N)^{1/2}$, more so for a simple Gaussian with $q_s=1$. This is because they also do not account for a high probability of speech at very low power, including temporary speech absence. The extended Gaussian model with $q_s=0.5$ has the least error here. Lastly, the Gaussian models also tend to understimate the noise at intermediate values of $(r^2/P_N)^{1/2}$, since (relative to GMM5) they expect a higher probability of speech components in this regime.

The probability of a speech signal being present at each frequency and time is adaptively estimated and updated throughout the processing. Using the above described a priori distribution functions for noise and speech spectral amplitudes, $q_s(r)$ which is the probability of speech signal presence given a new measurement of the noisy signal spectral amplitude, can be expressed in Equations 7, 8, 9 and 10, where $f(r\backslash S)$ is the measurement's distribution function conditioned on a signal being present.

$$q_S(r) = f(r\backslash S) q_S / f_r(r) \quad \text{Equation 7}$$

The distribution function $f(r\backslash S)$ can be expressed as $$f(r\backslash S) = \int ds\, f_s^{\circ}(s) f(r\backslash s) \quad \text{Equation 8}$$

where $f_s^{\circ}(s)$ is the GMM from the second term of $f_s(s)$ defined in Equation 2 and since speech and noise time samples are additive, $$f(r\backslash s) = (2r/P_N) Exp(-(r^2+s^2)/P_N) I_0(2rs/P_N) \quad \text{Equation 9}$$

This leads to the result $$q_S(r) = \quad \text{Equation 10}$$

-continued $$\left[1 + \frac{1-q_S}{q_S}\left\{\sum_i a_i (1+S_i)^{-1} \mathrm{Exp}\left(\frac{S_i}{1+S_i}(r^2/P_N)\right)\right\}^{-1}\right]^{-1}$$

Figure 3:
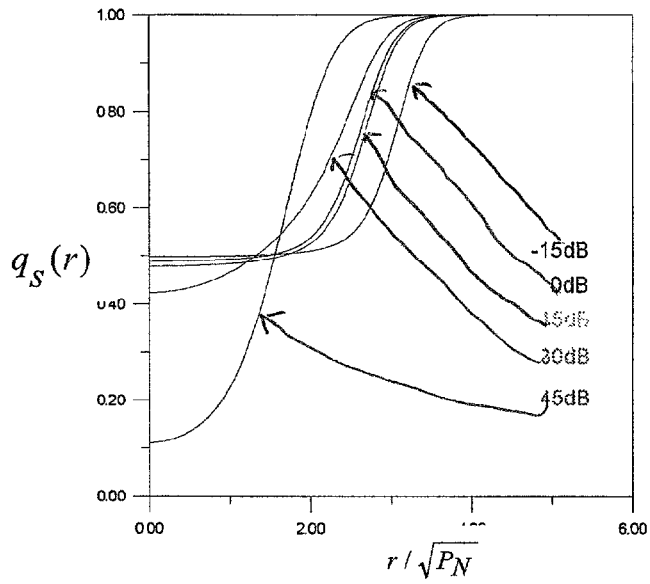
FIG. 3 is a graph illustrating a typical speech presence estimator for a GMM speech model.

FIG. 3 graphically depicts the $q_s(r)$ estimator defined in Equation 10 versus $(r^2/P_N)^{1/2}$, for a typical GMM speech distribution model, at various values of SNR, and $q_s=1/2$. As shown, the ability to discriminate speech presence versus absence at low values of $r^2/P_N$ also requires very high SNR. Compared to a Gaussian speech model, this is due to the higher probability of lower power speech components, which also is balanced in the long-tailed GMM speech model by a higher probability of higher power speech components.

In a manner similar to the previous explanation, the speech power versus time and frequency can be estimated using Equations 11 and 12. Where $<s^2\backslash r>$ is the a posteriori speech power (PSD) estimate given a new measurement of noisy signal r(f), the optimal estimator is as shown in these equations.

$$<s^2\backslash r> = \int ds\, s^2 f(r\backslash s) f_s(s) / f_r(r) \quad \text{Equation 11}$$

Evaluation of the above leads to the following.

$$<s^2 \mid r> = \frac{q_S P_N \sum_i a_i \frac{S_i}{(1+S_i)^2}\left(1 + \frac{r^2}{P_N}\{S_i/(1+S_i)\}\right) \mathrm{Exp}\left[(r^2/P_N)\left(\frac{S_i}{1+S_i}\right)\right]}{(1-q_S) + q_S \sum_i a_i (1+S_i)^{-1} \mathrm{Exp}\left[(r^2/P_N)\left(\frac{S_i}{1+S_i}\right)\right]} \quad \text{Equation 12}$$

Figure 4A:
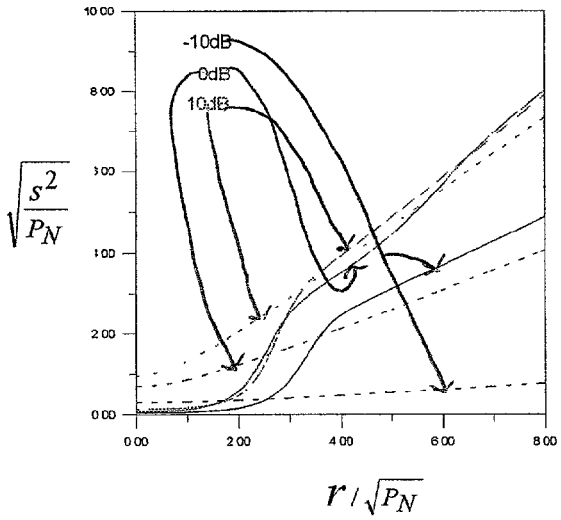
FIG. 4*a* is a graph of a speech power (PSD) estimator for a GMM speech distribution as compared to a Gaussian speech distribution.
Figure 4B:
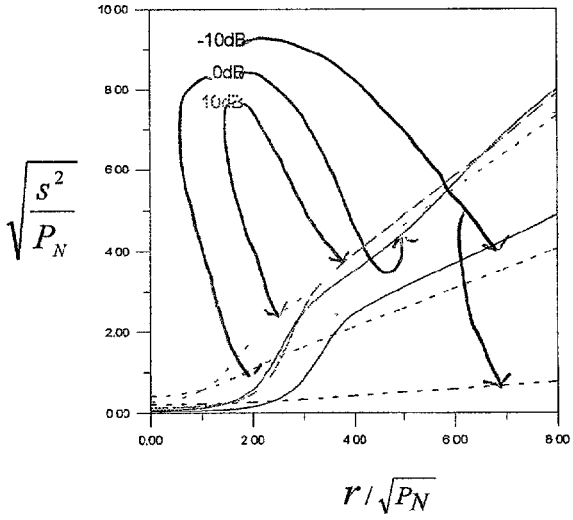
FIG. 4*b* is a graph showing a speech power (PSD) estimator for a GMM speech distribution compared to an extended Gaussian speech distribution that includes a non-unity probability of speech signal presence.

The form of this estimator is depicted in FIGS. 4*a* and 4*b*. In these figures, the vertical axis is $(<s^{2\backslash r>}/P_N)^{1/2}$, and the horizontal axis is $(r^2/P_N)^{1/2}$. GMM5 results are given for different SNRs, a nominal speech distribution function at $q_s=0.5$, and as compared with a Gaussian speech model at $q_s=1.0$, and also an extended Gaussian modes at $q_s=0.5$. GMM5 results are in solid lines and Gaussian models are shown as dashed lines.

In a manner similar to the previous explanation, the speech spectral amplitude can also be estimated as follows.

$$<s \mid r> = \frac{q_S \sum_i \frac{a_i S_i}{(1+S_i)^2} \mathrm{Exp}\left[\left(\frac{r^2}{P_N}\right)\left(\frac{S_i}{1+S_i}\right)\right]}{(1-q_S) + q_S \sum_i \frac{a_i}{1+S_i} \mathrm{Exp}\left[\left(\frac{r^2}{P_N}\right)\left(\frac{S_i}{1+S_i}\right)\right]} r \quad \text{Equation 13}$$

Note that in the special case with only one GMM component in the speech distribution function, and also with $q_s=1$, the above expression reduces to a conventional Wiener filter.

Figure 5A:
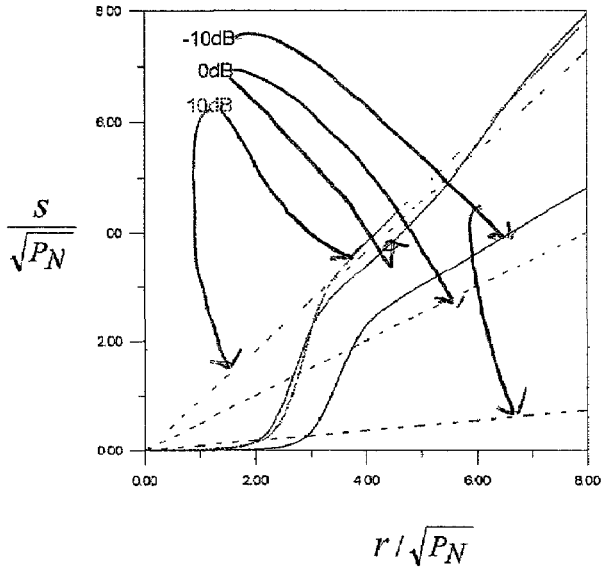
FIG. 5*a* is a graph showing a speech spectral amplitude estimator for a speech GMM compared with a basic Gaussian model.
Figure 5B:
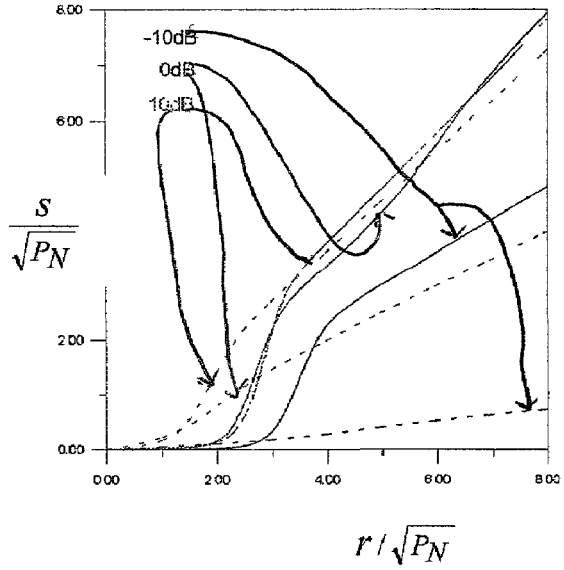
FIG. 5*b* is a speech spectral amplitude estimator for a GMM speech distribution compared with an extended Gaussian model that includes a non-unity probability of signal presence.

For a typical set of GMM parameters, and at $q_s=0.5$, and for different SNRs, the form of this estimator is shown in FIGS. 5*a* and 5*b*, where it is also compared with a Wiener filter at $q_s=1.0$, and also with an extended Wiener filter based on a Gaussian speech model but with $q_s=0.5$. In the figures, the vertical axis is $<s\backslash r>/(P_N)^{1/2}$, and the horizontal axis is $(r^2/P_N)^{1/2}$.

It is further noted that the availability of separate estimates for both the speech spectral amplitude <s\r> and the speech PSD <s²\r> allows the option to avoid explicit evaluation of the noise PSD estimator in Equation 6, since the same result can also be obtained as follows.

$$\langle n^2 \backslash r \rangle = r^2 - 2\vec{r} \cdot \langle \vec{s} \backslash \vec{r} \rangle + \langle s^2 \backslash r \rangle \qquad \text{Equation 14}$$

Figure 6:
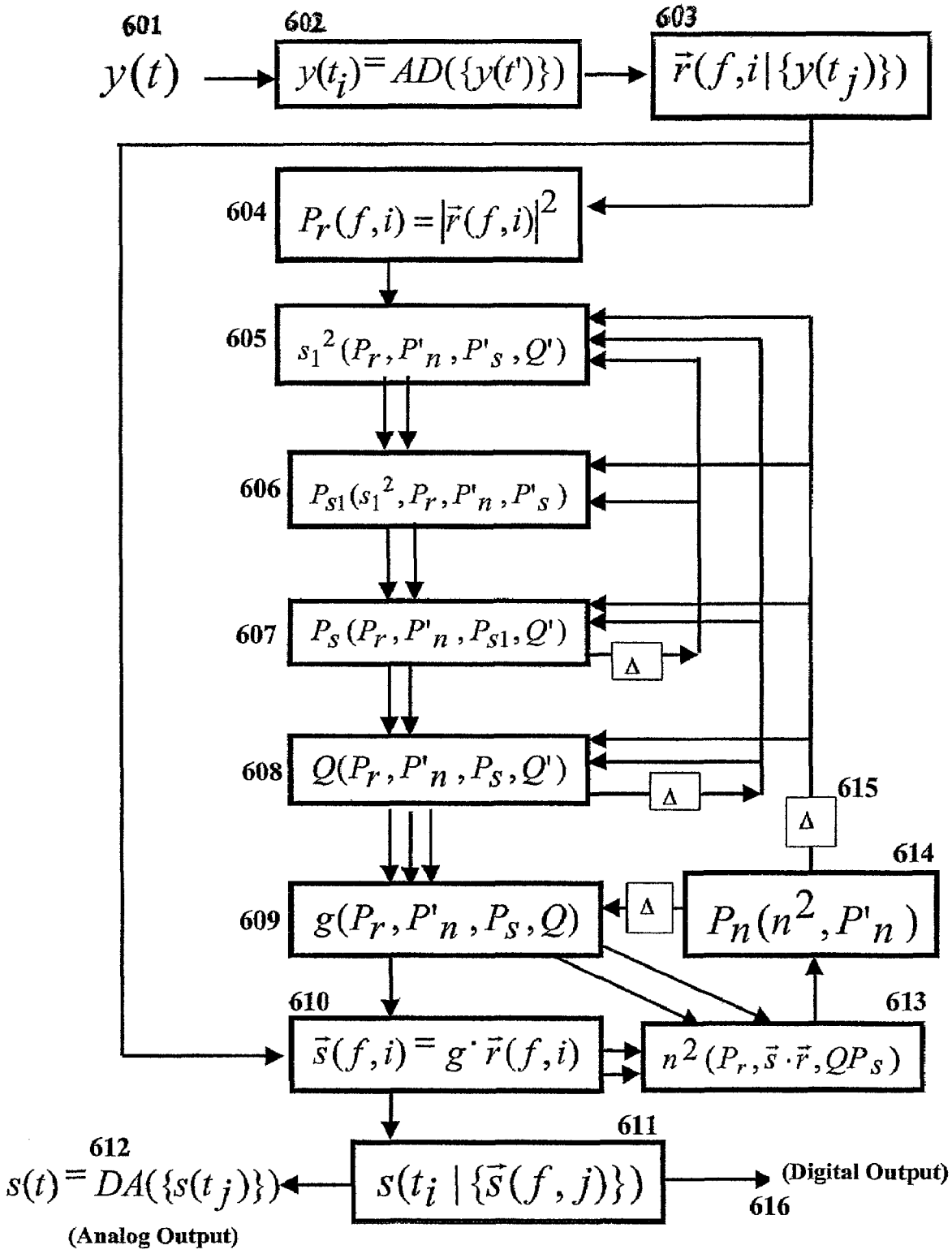
FIG. 6 is a block diagram flow chart showing one preferred embodiment of the method of the invention.

FIG. 6 shows a processing chain for one preferred embodiment of the method of the invention. The processing chain is outlined in terms of processing steps performed in sequence for each successive (overlapping) frame of noisy input. These steps are further detailed in the following discussion. While this figure indicates a final output based on an estimate of the information signal spectral amplitude (equivalent to an optimal waveform estimator), the option for outputs based on the signal PSD also will be apparent, and may be preferred in certain cases.

In FIG. 6, a noisy signal y(t) (601) is received and is passed through an analog to digital converter (602) to provide a stream of digital samples of the input signal $\{Y_i\}$. A windowing function is then applied to produce a frame of input samples, which is then frequency analyzed typically by Fourier analysis (603) to produce the complex spectral components {r(f)} of the noisy signal in that frame. Sampling the outputs from a bank of band-pass filters is also an option for performing such time-frequency analysis. A preferred frame length is typically 500 milliseconds, but other frame lengths can be used. Each frame is processed in succession. Each frame is chosen to overlap with its prior frame by an amount ranging from 50% to as much as 90%.

At (604) the complex spectral components are converted to the PSD $P_r(f)$ of the noisy input. At (605) a first estimate of the a posteriori PSD of the information signal $s_1^2$ is made using an implementation of Equation 12 with $q_s=1$. This represents a first estimate of the information signal PSD on the condition that a signal is present. At (606) this quantity is combined in a weighted combination with the a priori signal PSD $P_s'$ to stabilize this first estimate against errors. The result is denoted as $P_{s1}$. Then, at (607) a second and typically final estimate of the information signal PSD, denoted as $P_s$, is made using an implementation of Equation 12 with $q_s=1$, now using $P_{s1}$ as the a priori value for the information signal PSD. In other implementations of the method of the invention either more or fewer than two iterations of information signal PSD updating may be employed, as well as other variations in the details of the procedure.

At (608) the a priori signal presence probability $q_s$ is updated, using an implementation of Equation 10, with the updated signal PSD. At (609) a filter gain for recovering the spectral components of the information signal is estimated using updated a priori quantities from previous stages and an implementation of Equation 13. In some embodiments of the method this filter gain is also smoothed versus frequency and also versus time to reduce the tendency for producing sporadic output anomalies known in the prior art as "musical noise." In other embodiments the gain may be based on the square-root of the updated signal PSD multiplied by the updated signal presence probability and divided by the noisy signal PSD, or on a weighted combination of this gain with the former, and a weighting parameterized by other quantities made available through the methods of the invention.

At (610) the spectral amplitude gain versus frequency is multiplied by the corresponding noisy signal input spectral components to recover the spectral components of the information signal in the frame being processed. At (611) the recovered information signal spectral components are converted to time samples typically using inverse Fourier analysis techniques, and are overlapped and added to corresponding time sample outputs from adjacent overlapping frames using techniques mainly based on the prior art. At (612) these time samples are passed through a digital-to-analog converter to provide an analog output if such is desired, or at (616) the digital time samples are passed to a subsequent digital processing stage if such is desired.

Also, at (613) the noise PSD for the frame being analyzed is estimated, typically using an implementation of Equation 14, which allows the estimate from Equation 6 to be more efficiently done based on the other updated quantities already available. Then, at (614) this current frame noise PSD estimate is combined with prior-frame noise power estimates in a weighted average typically based on exponential time smoothing and typically with a time constant in the range of 0.2–2.0 seconds, which time constant may be adjusted according to requirements of the application, and also adaptively adjusted based on quantities that are made available from the methods of the invention.

The block and symbol at (615) and corresponding uses of this block and symbol elsewhere in the diagram of FIG. 6 represents the inter-frame time delay that exists between the estimation of quantities in a current frame of input data and their use as a priori quantities for the next overlapping frame of input data.

While we have illustrated and described one preferred embodiment of the present invention, it is understood that this invention is not limited to the precise instructions herein disclosed, and the right is reserved to all changes and modifications coming within the scope of the invention as defined in the following appended claims.

What is claimed is:

1. A method of extracting an information signal from input signal containing both the information signal and noise, including the steps of:

decomposing the input signal into multiple spectral bands utilizing Fourier transforms;

estimating a non-Gaussian distribution function model for the information signal spectral amplitude;

dynamically updating said non-Gaussian distribution function model for said information signal spectral amplitude;

producing a gain function for each of said spectral bands utilizing said dynamically undated non-Gaussian distribution function for said information signal spectral amplitude;

applying said gain function for each of said spectral bands to the input signal spectral bands to produce estimated information signal components for each of said spectral bands; and combining said estimated information signal components for all of said spectral bands to produce an estimate of the information signal with reduced noise.

2. The method in accordance with claim 1, wherein said non-Gaussian distribution function model for the information signal is a Gaussian Mixture Model.

3. The method in accordance with claim 1, further including the step of estimating current information signal power.

4. The method in accordance with claim 1, further including the step of estimating current noise power.

5. The method in accordance with claim 4, further including the step of estimating current information signal power.

6. The method in accordance with claim 5, wherein said non-Gaussian distribution function model for the information signal is a Gaussian Mixture Model.

7. The method in accordance with claim 5, further including the step of estimating current probability of information signal presence.

8. The method in accordance with claim 7, wherein said non-Gaussian distribution function model for the information signal is a Gaussian Mixture Model.

9. The method in accordance with claim 1, further including the steps of:

estimating current information signal power based upon input signal power, prior information signal power, noise power, and probability of information signal presence;

estimating current noise power based upon input signal power, information signal power, prior noise power, and probability of information signal presence; and estimating current probability of information signal presence based upon input signal power, information signal power, noise power, and prior probability of information signal presence.

10. The method in accordance with claim 9, wherein said non-Gaussian distribution function model for the information signal is a Gaussian Mixture Model.

11. A system for extracting an information signal from an input signal containing both the information signal and noise, comprising:

means for estimating a non-Gaussian distribution function model for the information signal spectral amplitude;

means for decomposing the input signal into multiple spectral bands utilizing Fourier transforms;

means for dynamically updating said non-Gaussian distribution function model for said information signal spectral amplitude;

means for producing a gain function for each of said spectral bands utilizing said dynamically undated non-Gaussian distribution function for said information signal spectral amplitude;

means for applying said gain function for each of said spectral bands to the input signal spectral bands to produce estimated information signal components for each of said spectral bands; and means for combining said estimated information signal components for all of said spectral bands to produce an estimate of the information signal with reduced noise.

12. The system in accordance with claim 11, further including means for producing current information signal power for each of said spectral bands based upon input signal power, prior information signal power, noise power and probability of information signal presence in the input signal.

13. The system in accordance with claim 12, further including means for producing current noise power for each of said spectral band, based upon input signal power, information signal power, prior noise power and probability of information signal presence in the input signal.

14. The system in accordance with claim 13, further including means for producing current probability of information signal presence for each of said spectral bands based upon input signal power, information signal power, noise power and prior probability of information signal presence in the input signal.

15. The system in accordance with claim 14, wherein said non-Gaussian distribution function model for the information signal is a Gaussian Mixture Model.

* * * * *